US011077977B2

(12) United States Patent
Markert et al.

(10) Patent No.: US 11,077,977 B2
(45) Date of Patent: Aug. 3, 2021

(54) LABEL ROLL AND MACHINE HAVING A LABEL ROLL

(71) Applicants: Florian Markert, Feldkirch (AT); Christoph Dautz, Bonn (DE); Markus von Gostomski, Bonn (DE)

(72) Inventors: Florian Markert, Feldkirch (AT); Christoph Dautz, Bonn (DE); Markus von Gostomski, Bonn (DE)

(73) Assignee: Deutsche Post AG, Bonn (DE)

( * ) Notice: Subject to any disclaimer, the term of this patent is extended or adjusted under 35 U.S.C. 154(b) by 0 days.

(21) Appl. No.: 16/517,250

(22) Filed: Jul. 19, 2019

(65) Prior Publication Data

US 2020/0024020 A1 Jan. 23, 2020

(30) Foreign Application Priority Data

Jul. 20, 2018 (DE) ..... 10 2018 117 627.9

(51) Int. Cl.

| | |
|---|---|
| ***B41J 3/407*** | (2006.01) |
| ***B65C 9/18*** | (2006.01) |
| ***B65C 9/46*** | (2006.01) |
| ***B65D 83/08*** | (2006.01) |

(52) U.S. Cl.

CPC ..... *B65C 9/18* (2013.01); *B41J 3/4075* (2013.01); *B65C 9/46* (2013.01); *B65D 83/0805* (2013.01)

(58) Field of Classification Search

None

See application file for complete search history.

(56) References Cited

U.S. PATENT DOCUMENTS

| | | | | |
|---|---|---|---|---|
| 4,841,317 | A | 6/1989 | Westell | |
| 5,292,084 | A * | 3/1994 | Lofstrom | B21C 47/006 242/530.4 |
| 6,038,731 | A * | 3/2000 | Hara | B41F 35/00 15/256.51 |
| 6,390,584 | B1 | 5/2002 | Larson et al. | |
| 6,648,533 | B2 * | 11/2003 | Lo | B41J 3/4075 156/234 |
| 8,590,826 | B2 * | 11/2013 | Pappas | B65H 75/50 242/533.4 |

FOREIGN PATENT DOCUMENTS

| | | | |
|---|---|---|---|
| CN | 1429753 | A | 7/2003 |
| CN | 204423518 | U | 6/2015 |
| DE | 689 11 739 | T2 | 5/1994 |
| DE | 20 2005 002248 | U1 | 4/2005 |
| JP | S59-203 045 | A | 11/1984 |
| JP | H07-215 594 | A | 8/1995 |
| JP | 2003 160264 | A | 6/2003 |

* cited by examiner

*Primary Examiner* — Alejandro Valencia

(74) *Attorney, Agent, or Firm* — Reinhart Boerner Van Deuren P.C.

(57) ABSTRACT

The invention describes, and illustrates, a label roll having a roll core and having a label tape, which is wound up onto the roll core. In order that the amount of time and effort required for changing over the label rolls can be reduced without a disproportionately large amount of space having to be provided for the label compartment, provision is made for the roll core to have a plurality of rollers distributed over its circumference, around which the label tape is wound.

16 Claims, 5 Drawing Sheets

LABEL ROLL AND MACHINE HAVING A LABEL ROLL

CROSS-REFERENCE TO RELATED PATENT APPLICATION

This patent application claims priority to German Application No. 10 2018 117 627.9, filed Jul. 20, 2018, the entire teachings and disclosure of which are incorporated herein by reference thereto.

FIELD

The invention relates to a label roll having a roll core and having a label tape, which is wound up onto the roll core. The invention also relates to a machine, in particular shipment locker, for accommodating and/or discharging shipments, in particular items, packaged items and/or parcels, having at least one label roll which is accommodated in a label compartment and has a label tape, and having a dispensing device for at least partially dispensing the label tape to a user and/or for at least partially dispensing to a user a label strip which is borne by the label tape and/or for dispensing to a user labels which are borne by the label tape.

BACKGROUND

Very different configurations of machines which, upon request, accept an item and/or dispense an item and/or provide straightforward services, for example gaming machines, photo booths, cash machines, money-exchange machines and vending machines, are known. It is also possible for machines to be designed in the form of automated parcel lockers, so-called packstations, at which customers can pick up and post certain shipments around the clock. Such machines can be referred to in quite general terms as shipment lockers, which serve to accommodate and/or discharge shipments, in particular items, packaged items and/or parcels. It is therefore not necessarily the case that the objects accommodated and/or discharged are parcels in the actual sense. Accordingly, it is also not necessarily the case that the shipment lockers have to be operated by courier services, express services and/or mail services.

In many cases, these machines comprise a label roll, and a dispensing device for labels, in a compartment provided for this purpose. These labels can be, for example, customer receipts, which for example show which service has been provided, at what cost, by the machine. It is possible here for the labels to be stored in the label roll in an already prefabricated state or to be printed individually, at least to some extent, by a printer prior to the labels being dispensed.

The label roll here comprises a roll core having a circular cross section, on which a label tape is wound up. The label tape, for the purpose of labels being dispensed, is partially unwound and likewise partially dispensed from the dispensing device to the person operating the machine. Depending on the desired use, there is a fair variety of known label tapes. In a simple scenario, the label tape is dispensed in its entirety, section by section, out of the dispensing device. If the label tape has been perforated, or is perforated prior to being dispensed, in each case the front, free end of the label tape can be torn off by the user. In the case of adhesive labels, it is possible for these, in the first instance, to be adhesively bonded to the label tape in a detachable manner and to be dispensed one after the other from the dispensing device. The adhesive labels are detached from the label tape beforehand when the adhesive labels are provided for immediate adhesive bonding. However, it is also possible for the adhesive labels to be dispensed together with a piece of the label tape when the intention is for the adhesive label to be adhesively bonded to a substrate by the user, as required, at a later point in time.

In order that each user can receive a label and/or to avoid the situation where machines have to be taken out of operation, it has to be ensured that the label rolls are replaced before there is no longer any possibility of a label being dispensed. It is therefore the case that a worker has to change over the used-up label roll for a new label roll. In particular in the cases in which the label rolls, for whatever reasons, cannot be changed over by the same worker who fills the machine with new items, perhaps because this worker is not authorized or permitted to do so, or in cases in which the machine never, or only very rarely, has to be filled with new items, the operation of changing over the label rolls involves a large amount of time and effort. In order to mitigate this, use is made of fairly large label rolls, but these can take up a not inconsiderable amount of space.

The present invention is therefore based on the object of configuring, and developing, the label roll and the machines in each case of the type mentioned in the introduction, and explained in more detail above, such that the amount of time and effort required for changing over the label rolls can be reduced without a disproportionately large amount of space having to be provided for the label compartment.

BRIEF SUMMARY

This object is achieved in the case of a label roll according to present disclosure in that the roll core has a plurality of rollers distributed over its circumference, around which the label tape is wound.

The aforementioned object is additionally achieved in the case of an shipment locker according to the present disclosure in that the label roll is designed according to the present disclosure.

The invention has found that relatively long label tapes can be wound up in a space-saving manner onto roll cores of label rolls if the roll cores have a plurality of rollers distributed over the circumference, around which the label tape is wound. Therefore, rather than the roll core itself forming the roller by which the label tape is unwound, the label tape is unwound by the rollers provided around the circumference. There is therefore no need for the roll core as such to rotate. This makes it possible for the roll core to be adapted as best possible to space available for the label compartment, since the shape of the roll core, that is to say in particular the roll-core cross section around which the label tape is wound, need no longer be circular; rather, it may be of some other shape. Although this shape may make it impossible for the roll core itself to rotate in the label compartment assigned to the roll core, for the purpose of unwinding the label tape, it is nevertheless the case that the label tape can be unwound or unrolled via the rollers arranged around the circumference of the roll core.

In order to give a better understanding, and to avoid unnecessary repetition, the roll core and the machine will be described together hereinbelow without specific distinctions being made in each case between the label roll and the machine. A person skilled in the art, however, can gather from the context which feature is particularly preferred in each case in relation to the label roll and the machine.

In the case of a first, particularly preferred configuration of the label roll, the roll core has an elongate, preferably at least essentially oval or at least essentially rectangular, cross section around which the label tape is wound. This makes it possible to utilize the space of a rectangular label compartment for the label roll and/or for a long label tape. It is expedient here, in particular in order to avoid accidental detachment of adhesive labels, if the roll core has rounded corners. This applies, in particular, in the case of an otherwise essentially rectangular cross section around which the label tape is wound.

The rollers of the label roll are provided preferably at fixed locations along the circumference of the roll core, in order to ensure reliable operation of the label roll. In order to avoid slippage of the label tape on the rollers, or to avoid the label tape slipping off from the roll core, it is recommended for the rollers to be designed in the form of rubber-coated rollers. The rollers here need not necessarily have rubber on their outer side. A plastic with a fairly high coefficient of friction would be sufficient here. What is to be understood by a fairly high coefficient of friction also depends on the material of the label tape, and therefore cannot be specified definitively here. Rubber-coated rollers are therefore preferably taken to mean those as typically understood by a person skilled in the art. In order for the rollers to be retained in a reliable manner, the label roll can have a roll-core housing, on or in which the rollers are secured. This can be achieved in a particularly expedient manner in that the spindles of the rollers are retained in the roll-core housing.

In order to avoid unintended unrolling of the label tape, and/or to simplify the rolling-up operation of the label tape, the roll core can have at least one brake lining, which can brake at least one of the rollers arranged around the circumference. In particular, it is expedient here if the at least one brake lining is adjustable from a braking position, in which it butts in a force-fitting manner against at least one roller, into a release position, in which it is spaced apart from the at least one roller, and back. In order not to obstruct the winding-up and unwinding operations of the label tape, in the braking position, the at least one brake lining can butt in a force-fitting manner against the at least one roller on a side of the at least one roller which in each case is directed at least essentially away from the label tape. In other words, the at least one brake lining can be provided in the interior of the roll core, whereas the label tape is provided on the outer side of the roll core. The braking action can be increased if that side of the brake lining which interacts with the at least one roller is provided from rubber or a suitable plastic which provides in particular, on the one hand, resistance and, on the other hand, a high coefficient of friction.

The brake lining can be adjusted from the release position into the braking position and back in a reliable and straightforward manner if the at least one brake lining is assigned at least one spring means such that the restoring force assists the adjustment of the at least one spring means into the braking position and/or into the release position. It is particularly straightforward here, in particular so as to avoid unnecessary adjustment devices, if the at least one spring means causes, rather than just assists, the corresponding adjustment of the brake lining.

In order to be able to ensure, and reliably control, error-free operation of the label roll, it can be expedient if the at least one brake lining is formed at least to some extent from a magnetic material. This is because the at least one brake lining can then be assigned at least one electromagnet such that the at least one electromagnet can retain the brake lining in the release position and/or the braking position as a result of the magnetic force. The at least one electromagnet retains the at least one brake lining in the release position and/or the braking position preferably counter to the restoring force of the at least one spring means. As a result of the at least one electromagnet being energized, the at least one electromagnet generates a magnetic field, which ensures that the brake lining is arrested in the magnetic field. Either the brake lining is retained in the release position, in order to allow the label tape to be drawn off, or the brake lining is retained in the braking position, in order to prevent the aforementioned or for it to be possible for a label tape to be wound up onto the roll core. In the release position, the at least one brake lining can butt against the at least one electromagnet or against at least one release stop.

In order that the brake lining can be adjusted back and forth between the braking position and the release position in a specific manner, and in dependence on the operation of the machine, the at least one electromagnet is preferably assigned at least one control device for actuating the at least one electromagnet. In other words, the electromagnet can be energized to generate a magnetic field in a controlled manner by the control device, or not.

In order that the roll core, which according to the invention need not itself rotate, can be retained in a label compartment in a reliable manner and, as required, at a fixed location, it is recommended that the roll-core housing has lateral mounts, in particular grooves, for accommodating a holder for retaining the label roll in an shipment locker. It is therefore recommended here to have a form-fitting mount in a label compartment. However, it is also possible for the roll-core housing to be mounted via lateral protrusions, in particular tongues and/or ribs, which can engage in a mount of a holder in order to retain the roll-core housing and thus the label roll, to be precise, if required, in a label compartment of a machine. As an alternative, or in addition, the roll-core housing can also have lateral feet for positioning the roll-core housing on an underlying surface, for example in a label compartment of a machine. In order that the label tape here does not come into contact with the underlying surface, it is recommended if the label tape is then arranged in its entirety above the underlying surface, if the underlying surface is planar. The feet therefore have to be designed appropriately.

The label tape can be formed, if required, at least essentially from paper or plastic. It is possible here for the label tape itself to form the labels or to bear the labels. If the label tape itself forms the labels, the label tape can be severed step by step to create individual labels. It is also possible for parts of the label tape to be cut out, or punched out, one after the other. If provision is made for the labels created always to be of the same size, the label tape can be perforated at regular intervals in order for the labels to be severed. Otherwise, a perforating device can perforate the label tape once it has been drawn off from the roll core and prior to being dispensed to the user. Irrespective of the above properties of the label tape, it is possible for the label tape to bear at least one label strip, which is adhesively bonded to the label tape in a detachable manner, or to bear a plurality of labels which are arranged one behind the other and adhesively bonded to the label tape in a releasable manner. The labels or the label strip here can be of preferably self-adhesive design. For this purpose, the labels or the label strip can be provided with an adhesive layer which adhesively bonds the labels or the label strip to the label tape in a releasable manner and which can be detached from the label tape together with the labels or with the label strip. This adhesive layer then makes it possible for the labels or the label strip to be adhesively bonded to the desired substrate.

In the case of a label strip, this label strip can be divided up into individual labels before or after the label strip is dispensed.

In the case of a first, particularly preferred configuration of the machine, a printer, in particular a thermal printer, is provided for printing the label tape, the label strip and/or the labels. The labels can thus be printed individually, which can increase convenience for the user and can decrease the consumption of label tape. It is particularly effective and space-saving here if the printer draws off the label tape from the roll core for printing purposes. It is then possible, if required, to dispense with additional transporting devices for transporting the label tape. As an alternative, or in addition, the printer can be provided for dispensing the label tape, the label strip and/or the labels. It is then possible, if required, to dispense with additional transporting devices for dispensing the label tape. Quite fundamentally it is expedient, as far as the amount of space required, the reliability and the flexibility are concerned, if the printer is designed in the form of a thermal printer.

The machine preferably has an operating terminal for operation by the user. In this case, the operating terminal can interact with the control device such that, in dependence on the operation of the operating terminal and of corresponding actuation, the control device of the roll core activates or deactivates the at least one electromagnet. As an alternative, or in addition, it is nevertheless also possible for the at least one printer to be actuable for drawing off label tape from the label roll, for printing the label tape, for printing the label strip, for printing at least one label, for dispensing the label tape, for dispensing the label strip and/or for dispensing at least one label. It is therefore the case that the use of the label roll is controlled by the user, to be precise in accordance with predetermined criteria, as required via the operation of the operating terminal.

The operating terminal, for operation by the user, can have, if required, a keypad and/or a touchscreen, which provides for very straightforward and reliable operation of the machine. As an alternative, or in addition, it is nevertheless also possible for the operating terminal to have a receiving unit for receiving signals. The operating commands are then transmitted in the form of signals to the operating terminal, without the user having to actuate corresponding keys, fields or switches to this end. The operating terminal can comprise, for this purpose, for example reading devices, which are suitable for reading out Radio Frequency Identification (RFID) tags, Near Field Communication (NFC) tags and/or barcodes, in particular two-dimensional barcodes, or other storage media. Whereas a barcode can be read out typically by optical means, an RFID tag or NFC tag can be read out, if required, by means of a local wireless network. As an alternative, or in addition, the signal can be transmitted to the operating terminal via a local wireless network or a cellular network, for example Bluetooth or Wireless Local Area Network (WLAN) and/or a cellular network, in particular Global System for Mobile Communication (GSM), Universal Mobile Telecommunications System (UMTS) and/or Long-Term Evolution (LTE). The operating terminal then has corresponding receiving devices for this purpose.

The label roll can be deployed in a particularly effective and useful manner if the shipment locker is an automated parcel locker, in particular packstation, which allows the operator himself to pick up and/or post parcels. Certain requirements here mean that it is only certain people, typically not the mailmen or delivery agents themselves, who can change over the label rolls. Therefore, the operation of changing over the label rolls requires a particularly large amount of effort and time. It is also desirable for the machines to print out address stickers and/or return labels, for sending back returns. The user can then stick the stickers onto a parcel and then post the parcel into the machine. However, this option results in high consumption of label tape, for which reason there is particular interest here in the advantages according to the invention. This is also the case, however, when the machine is designed for printing customer receipts. Irrespective of whether a customer receipt, an address sticker, a return sticker or some other label is printed or dispensed, it is recommended if the corresponding label is printed and/or dispensed with reference to information predetermined via the operating terminal.

BRIEF DESCRIPTION OF THE DRAWING

The invention will be explained in more detail hereinbelow with reference to a drawing, which illustrates merely an exemplary embodiment and in which.

DETAILED DESCRIPTION

Figure 1A:
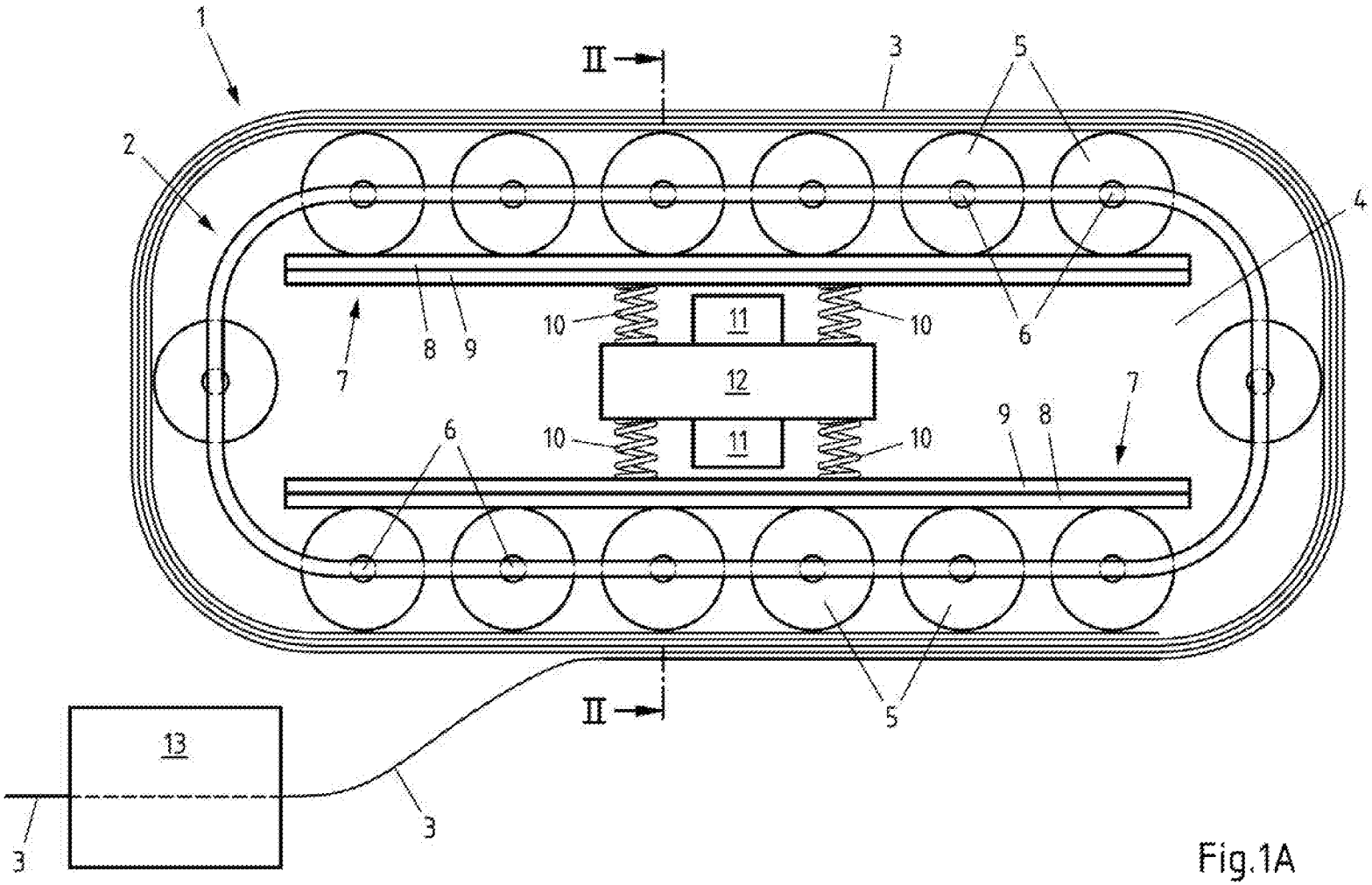
FIGS. 1A-B show a schematic side view of a label roll according to the invention.
Figure 1B:
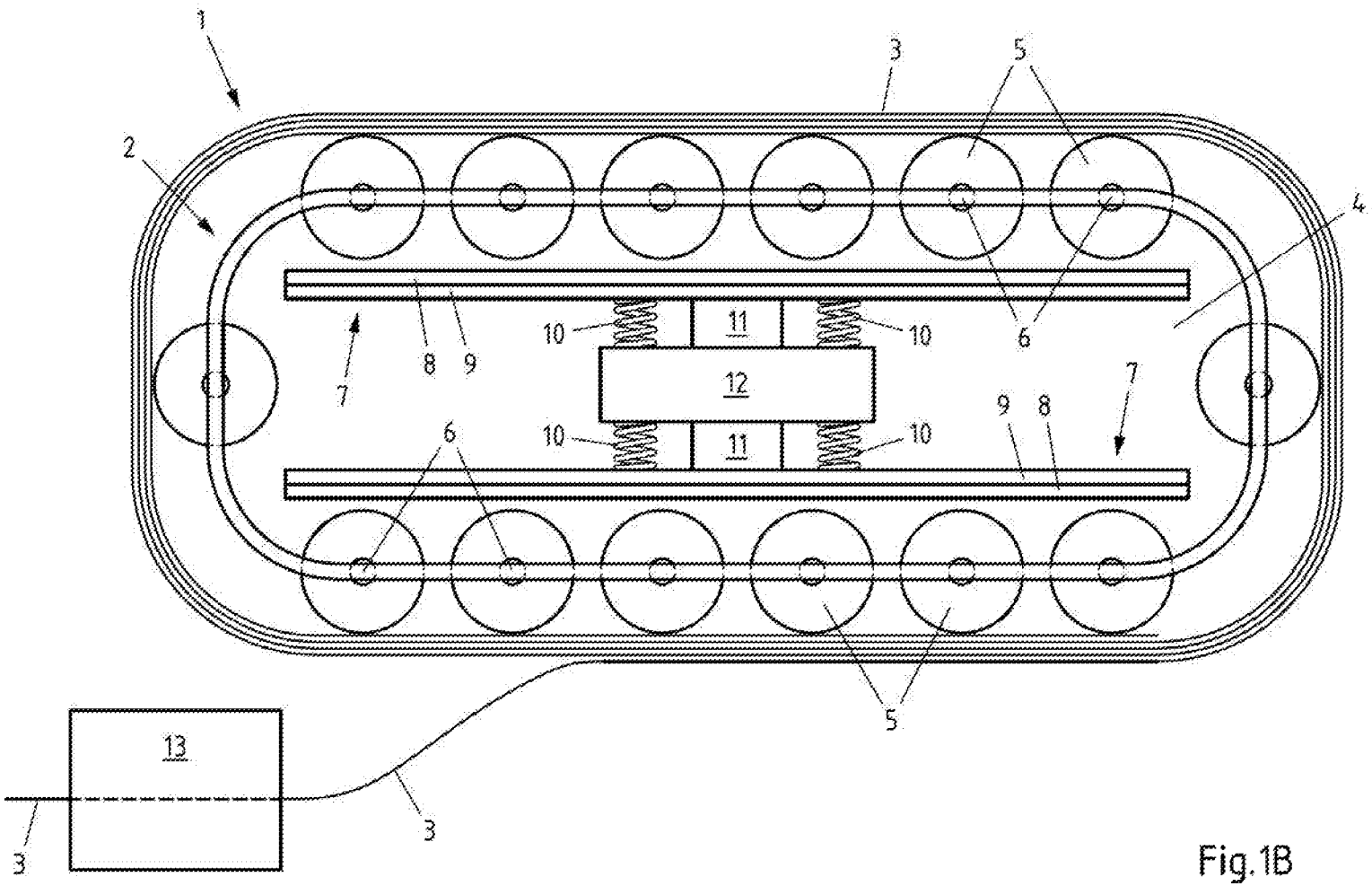
Figure 2:
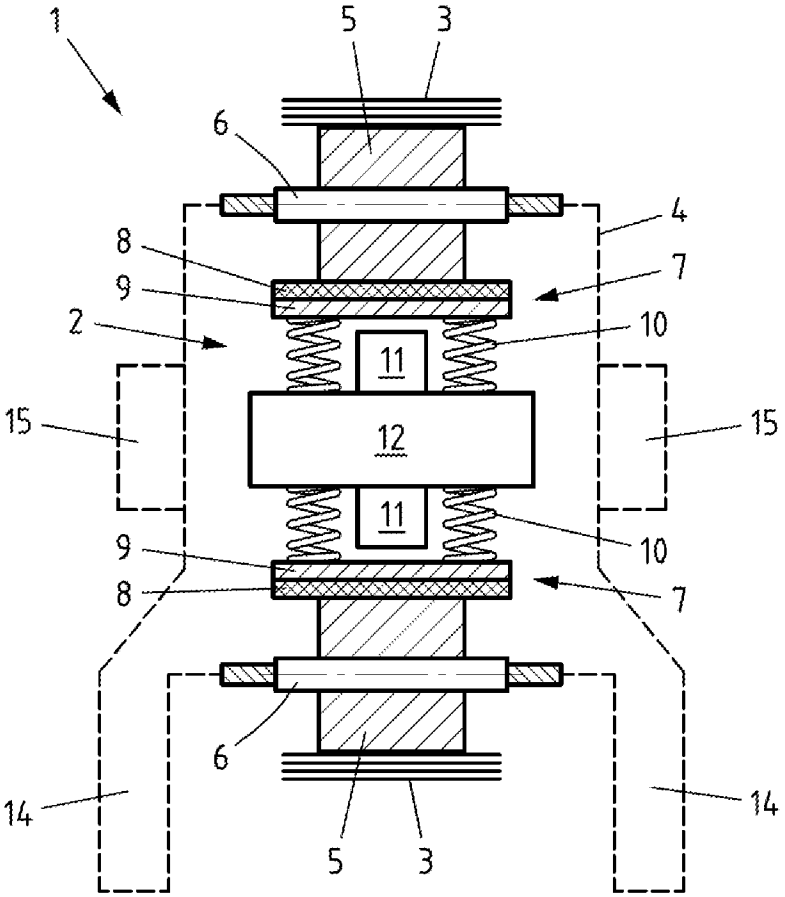
FIG. 2 shows a schematic front view of the label roll.

FIGS. 1A-B and 2 illustrate a schematic side view and a schematic sectional view of a label roll 1. The label roll 1 has a roll core 2, around the circumference of which a label tape 3 is wound, to be precise with a plurality of windings. The roll core 2 here comprises a roll-core housing 4, which, for reasons of clarity, is illustrated in a transparent state and by dashed lines, to allow an unobstructed view into the interior of the roll-core housing 4.

A plurality of rollers 5, which form part of the circumference of the roll core 2, are provided around the circumference of the roll core 2, as seen in cross section. The label tape 3 is wound around the rollers 5 and butts against the rollers 5 on the outer sides of the rollers 5. The rollers 5 are retained at fixed locations in the roll-core housing 4, to be precise via the spindles 6 of the rollers. When the label tape 3 is drawn off, the label tape 3 slides on the rollers 5 of the roll core 2, along the circumference of the roll core 2. The roll core 2 here, however, does not itself rotate or, at most, rotates only to an insignificant extent. The fact that the rollers 5 are rubber-coated, that is to say have rubber or a similar plastic, along the circumference of the rollers 5 is not illustrated specifically.

The inner sides of some rollers 5, that is to say those sides which are assigned to the interior of the roll-core housing 4, are assigned brake linings 7, which in FIG. 1A are illustrated in the braking position, in which they arrest the associated rollers 5, and in FIG. 1B are illustrated in the release position, in which they release the associated rollers 5. Adjacent to the rollers 5, the brake linings 7 illustrated, and to that extent preferred, have a rubber coating or a plastic 8. On the side which is directed away from the rollers 5, the brake linings 7 are produced from a magnetic metal 9. These sides are additionally assigned spring means 10 which, as a result of their spring forces, push the brake linings 7 outward, and against the rollers 5, in order thus to arrest the rollers 5 in the braking position and to prevent accidental unrolling of the label tape 3. In order to move the brake linings 7 into the release positions, in which said brake linings are separated from the rollers 5 and are arranged further inside the roll-core housing 4, so that the rollers 5 can rotate freely, electromagnets 11 are provided. If the latter are energized, the electromagnets 11 generate a magnetic field, which attracts the brake linings 7 and retains them in the release position, to be precise counter to the restoring forces of the spring means 10. In the release position, in the case of the roll core 2 illustrated, and to that extent preferred, the brake linings 7 butt against the electromagnets 11.

The electromagnets 11 are controlled by a control device 12. The control device 12 predetermines when the electromagnets 111 are energized and when not. The control device 12 therefore determines when the rollers 5 of the roll core 2 can rotate freely and when not. It is only when the rollers 5 can rotate freely that a section of the label tape 3 can be drawn off from the label roll 1. The operation of drawing off the label tape 3 here is caused by a printer 13, in particular thermal printer, which draws part of the label tape 3, for printing purposes, through the printer 13 and therefore, to that extent, draws it off from the label roll 1.

In order that this space in an elongate label compartment can be utilized effectively, it is also the case that the cross section of the roll core 2, around which the label tape 3 is wound, is of elongate design. This is illustrated in FIG. 1. The corners of the roll core 2 here are of rounded design, in order to ensure unrolling without damage to the label tape 3 or without accidental detachment of labels, or adhesive labels, from the label tape 3 at the corners of the roll core 2. It can be gathered from FIG. 2 that the label roll 1 has feet 14, in order to position the label roll 1 in a label compartment of a machine. The feet 14 here project downward to such an extent that the label tape 3 does not come into contact with the floor of the label compartment, which would obstruct the unwinding operation of the label tape 3. In addition, the roll-core housing 4 has lateral ribs 15, which can be introduced into mounts of the label compartment 17 in order to retain the label roll 1 1 in the desired position in the label compartment 17.

Figure 3:
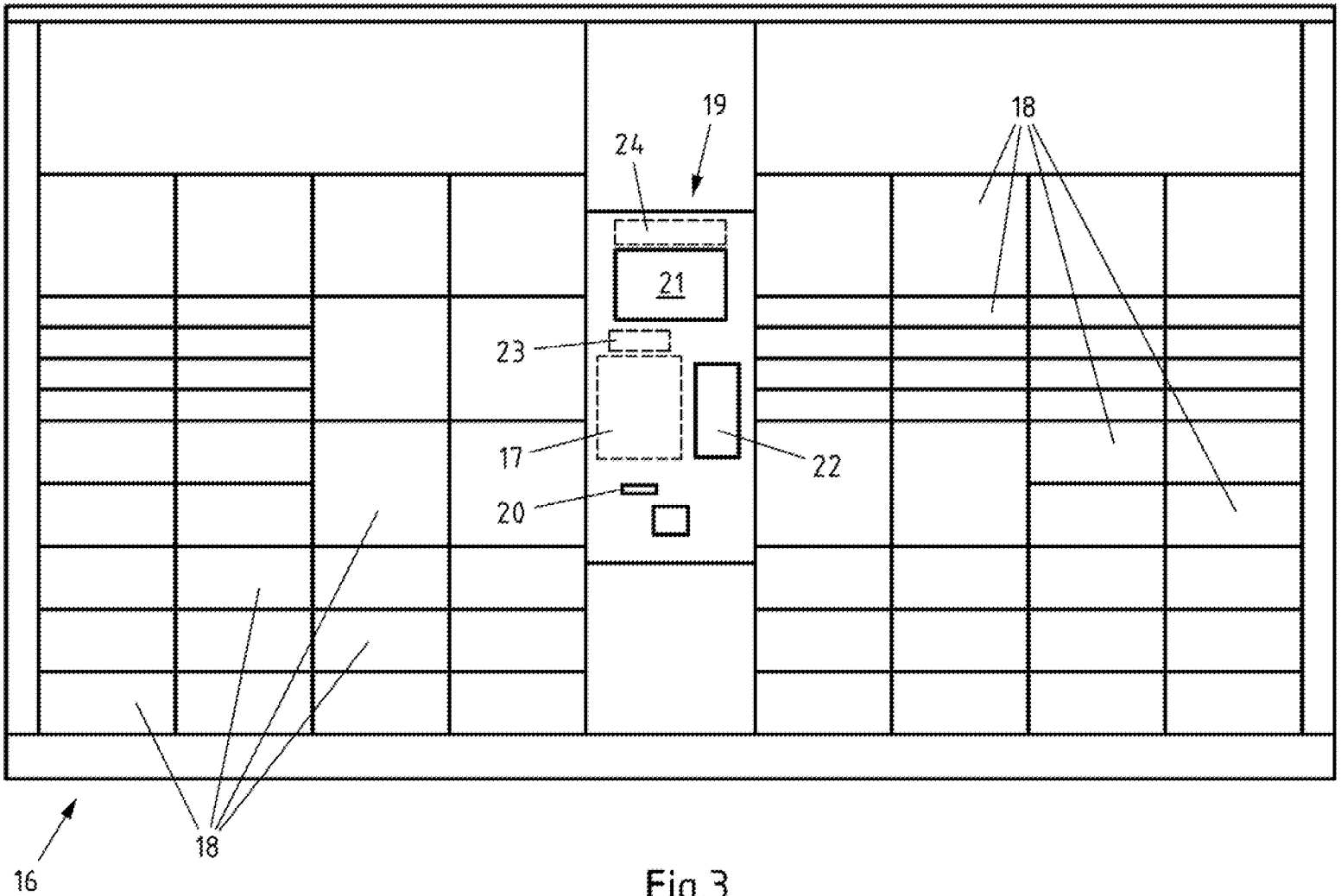
FIG. 3 shows a schematic front view of a machine according to the invention.

FIG. 3 illustrates a machine 16, in particular a shipment locker, for accommodating and/or discharging shipments, in particular items, packaged items and/or parcels, having a label compartment 17 for accommodating label rolls. The machine 16 is designed, in particular, in the form of an automated parcel locker, in particular packstation, which allows the operator himself to pick up and/or post parcels. For this purpose, the machine illustrated, and to that extent preferred, has a plurality of compartments 18 for accommodating parcels. The compartments 18 can be opened by a user, to be precise by means of an operating terminal 19. Additionally provided is a dispensing device 20, which is designed for at least partially dispensing the label tape 3 to a user and/or for at least partially dispensing to a user a label strip and/or labels which are borne by the label tape 3.

Figure 4:
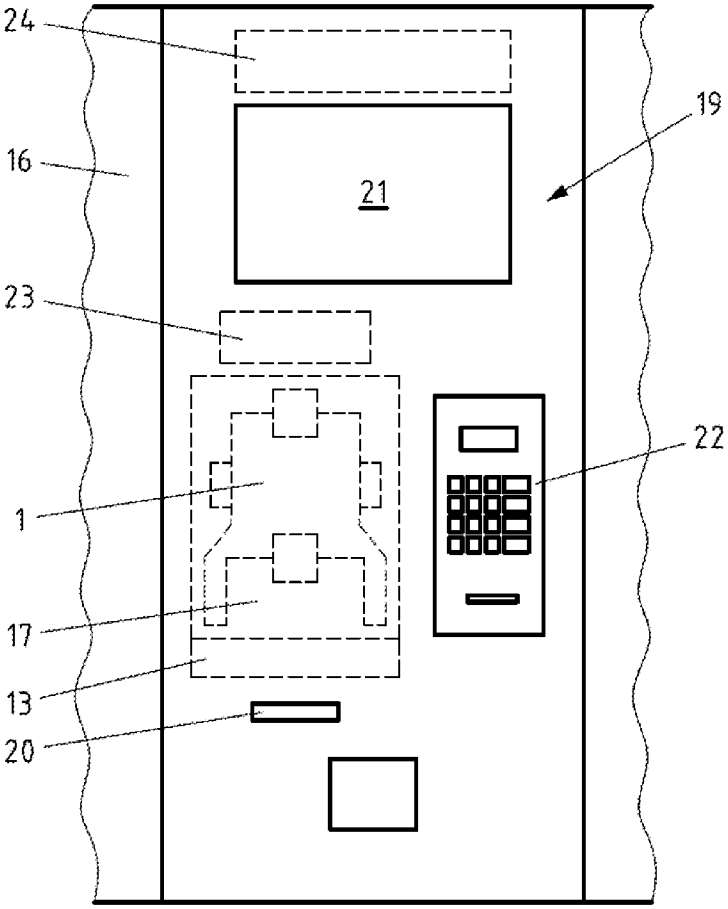
FIG. 4 shows a schematic front view of the operating terminal of the machine from FIG. 3.

The operating terminal 19 is illustrated in a detail-specific view in FIG. 4. The operating terminal 19 illustrated, and to that extent preferred, has a touchscreen 21 and a keypad 22, via which the operator can input information. However, the operating terminal 19 also has reading devices 23, which are capable of reading out barcodes, in particular two-dimensional barcodes, Radio Frequency Identification (RFID) tags and/or Near Field Communication (NFC) tags. Also provided are receiving devices 24 for receiving signals via a local wireless network or a cellular network, for example Bluetooth, Wireless Local Area Network (WLAN), Global System for Mobile Communication (GSM), Universal Mobile Telecommunications System (UMTS) and/or Long-Term Evolution (LTE). These are all ways in which the operator can transmit signals which contain, or constitute, control commands for the machine 16.

The operating terminal 19 for operation by the user is connected for interaction with the control device 12 such that, in dependence of the control commands input at the operating terminal 19, or transmitted to the operating terminal 19, the control device 12 of the roll core 2 is activated or deactivated. If the control device 12 is activated, the electromagnets 11 are energized, and this generates a magnetic field for adjusting the brake linings 7 into the release position. If the control device 12 is deactivated, the voltage supply to the electromagnets 11 is interrupted, and so the brake linings 7 pass into the braking position as a result of the restoring forces of the spring means 10. It is also possible, however, for the control device 12 and/or the operating terminal 19 to activate the printer 13, and so the latter draws off label tape 3 from the roll core 2, prints labels and passes the printed labels onwards to the dispensing device 20. The labels pass out of the machine 16 at the dispensing device 20 and can therefore be received by the user at the dispensing device 20.

The printer 13 is, in particular, a thermal printer which can print optionally the label tape 3, a label strip, which is borne by the label tape 3, or individual labels. The label strip and/or the labels here can be adhesively bonded to the label tape 3 in a detachable manner by a self-adhesive layer. The label strip or the labels is or are dispensed either with the label tape 3 or without the label tape 3. In the latter case, the used-up label tape 3 is collected in the machine 16 until being disposed of.

Figure 5:
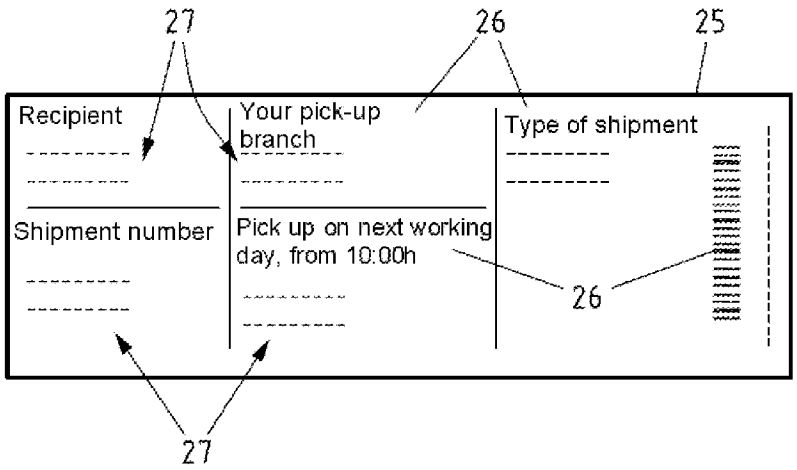
FIG. 5 shows a schematic plan view of a customer receipt or return label dispensed by the machine from FIG. 3.

The machine 16 illustrated is designed for printing and dispensing labels, in particular in the form of customer receipts, stickers and/or return labels, in particular with reference to information predetermined via the operating terminal 19. A corresponding label 25, for example in the form of a customer receipt, of a corresponding sticker and/or of a corresponding return label, is illustrated schematically in FIG. 5, wherein the label 25 in the exemplary embodiment illustrated, and to that extent preferred, already has preprinted pieces of information in regions 26, it being possible for said information to be supplemented in other regions 27 by individual pieces of information which can be printed specifically by the printer 13 of the machine 16. However, it is also possible, in particular if very different labels 25 are to be dispensed, for any information to be printed in the first instance by the printer 13 in the machine 16.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A label roll comprising:

a roll core; and a label tape, which is wound up onto the roll core;

wherein the roll core has a plurality of rollers distributed over its circumference, around which the label tape is wound; and wherein the roll core has an elongate cross section which is provided with rounded corners and around which the label tape is wound.

2. The label roll according to claim 1, wherein the longate cross section of the roll core is at least essentially oval or at least essentially rectangular.

3. The label roll according to claim 1, wherein the rollers are provided at fixed locations along the circumference of the roll core, and/or wherein the rollers are rubber-coated rollers, and/or wherein the rollers, in particular the roller spindles, are retained in a roll-core housing.

4. The label roll according to claim 1, wherein the roll core has at least one brake lining, and wherein the at least one brake lining is adjustable from a braking position, in which it butts in a force-fitting manner against at least one roller, into a release position, in which it is spaced apart from the at least one roller, and back, and wherein, preferably, in the braking position, the at least one brake lining butts in a force-fitting manner against the at least one roller on a side of the at least one roller which in each case is directed at least essentially away from the label tape.

5. The label roll according to claim 4, wherein the at least one brake lining is assigned at least one spring means such that the restoring force causes, or at least assists, the adjustment of the at least one spring means into the braking position and/or the release position.

6. The label roll according to claim 4, wherein the at least one brake lining is formed at least to some extent from a magnetic material, and wherein the at least one brake lining is assigned at least one electromagnet such that the at least one electromagnet can retain the brake lining in the release position and/or the braking position as a result of the magnetic force of the electromagnet, in particular counter to the restoring force of the at least one spring means.

7. The label roll according to claim 6, wherein the at least one electromagnet is assigned at least one control device for actuating the at least one electromagnet.

8. The label roll according to claim 1, wherein the roll-core housing has lateral mounts, in particular grooves, for accommodating a holder for retaining the label roll in a machine, and/or wherein the roll-core housing has lateral protrusions, in particular tongues and/or ribs, for engagement in a mount of a holder for retaining the label roll in a machine, and/or wherein the roll-core housing has lateral feet for positioning the roll-core housing on an underlying surface such that the label tape is arranged in its entirety above a planar underlying surface.

9. The label roll according to claim 1, wherein the label tape is formed at least essentially from paper or plastic, and/or wherein the label tape is perforated at regular intervals in order for individual segments of the label tape to be severed, and/or wherein the label tape bears at least one label strip, which is adhesively bonded to the label tape in a detachable manner, or bears a plurality of labels which are arranged one behind the other and are adhesively bonded to the label tape in a detachable manner.

10. A machine, in particular shipment locker, for accommodating and/or discharging shipments, in particular items, packaged items and/or parcels, comprising:

at least one label roll which is accommodated in a label compartment and has a label tape, and a dispensing device for at least partially dispensing the label tape to a user and/or for at least partially dispensing to a user a label strip which is borne by the label tape and/or for dispensing to a user labels which are borne by the label tape, wherein the label roll is designed according to claim 1.

11. The machine according to claim 10, wherein a printer, in particular thermal printer, is provided for printing the label tape, the label strip and/or the labels, and wherein, preferably, the printer draws off the label tape from the roll core for printing purposes, and/or wherein the printer, in particular thermal printer, is provided for dispensing the label tape, the label strip and/or the labels.

12. The machine according to claim 10, wherein an operating terminal for operation by the user is provided for interaction with the control device such that, in dependence on the operation of the operating terminal, the control device of the roll core is actuatable for activation and/or deactivation of the at least one electromagnet and/or the printer is actuable for drawing off label tape from the label roll, for printing the label tape, the label strip and/or the labels and/or for dispensing the label tape, the label strip and/or the labels.

13. The machine according to claim 12, wherein the operating terminal, for operation by the user, has a keypad, a touchscreen, reading devices for reading barcodes, in particular two-dimensional barcodes, Radio Frequency Identification (RFID) tags and/or Near Field Communication (NFC) tags and/or receiving devices for receiving signals via a local wireless network or a cellular network, for example Bluetooth, Wireless Local Area Network (WLAN), Global System for Mobile Communication (GSM), Universal Mobile Telecommunications System (UMTS) and/or Long-Term Evolution (LTE).

14. The machine according to claim 10, wherein the shipment locker is an automated parcel locker, in particular a packstation, which allows the operator himself to pick up and/or post parcels.

15. The machine according to claim 10, wherein the machine is designed for printing and dispensing labels, in particular in the form of customer receipts and/or return labels, in particular with reference to information predetermined via the operating terminal.

16. The label roll according to claim 1, wherein at least a portion of the label tape contacts the plurality of rollers when the label tape is wound onto the roll core.

* * * * *